US009284508B2

(12) United States Patent
Baran, Jr. et al.

(10) Patent No.: US 9,284,508 B2
(45) Date of Patent: Mar. 15, 2016

(54) LUBRICANT COMPOSITION AND METHOD OF FORMING

(71) Applicant: 3M INNOVATIVE PROPERTIES COMPANY, St. Paul, MN (US)

(72) Inventors: Jimmie R. Baran, Jr., Prescott, WI (US); Haeen Sykora, New Richmond, WI (US); Madeline P. Shinbach, St. Paul, MN (US); Roxanne A. Boehmer, Inver Grove Heights, MN (US); Daniel W. Wuerch, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 200 days.

(21) Appl. No.: 14/098,808

(22) Filed: Dec. 6, 2013

(65) Prior Publication Data

US 2014/0100145 A1 Apr. 10, 2014

Related U.S. Application Data

(62) Division of application No. 13/141,265, filed as application No. PCT/US2009/067607 on Dec. 11, 2009, now abandoned.

(60) Provisional application No. 61/141,314, filed on Dec. 30, 2008.

(51) Int. Cl.

| | |
|---|---|
| ***C10M 105/76*** | (2006.01) |
| ***C10M 139/04*** | (2006.01) |
| ***C10M 141/12*** | (2006.01) |
| ***C10M 171/06*** | (2006.01) |

(52) U.S. Cl.

CPC ..... *C10M 105/76* (2013.01); *C10M 139/04* (2013.01); *C10M 141/12* (2013.01); *C10M 171/06* (2013.01); *C10M 2201/062* (2013.01); *C10M 2201/105* (2013.01); *C10N 2210/02* (2013.01); *C10N 2210/03* (2013.01); *C10N 2210/04* (2013.01); *C10N 2210/08* (2013.01); *C10N 2220/082* (2013.01); *C10N 2230/06* (2013.01); *C10N 2230/68* (2013.01)

(58) Field of Classification Search

CPC ..... C10M 105/76; C10M 139/04; C10M 141/12; C10M 171/06; C10M 2201/062; C10M 2201/105; C10N 2210/02; C10N 2210/03; C10N 2210/04; C10N 2210/08; C10N 2220/082; C10N 2230/06; C10N 2230/68

See application file for complete search history.

(56) References Cited

U.S. PATENT DOCUMENTS

| | | | | |
|---|---|---|---|---|
| 3,565,985 | A | 2/1971 | Schrenk | |
| 4,767,726 | A | 8/1988 | Marshall | |
| 5,037,579 | A | 8/1991 | Matchett | |
| 5,427,847 | A | 6/1995 | Zawada | |
| 5,589,122 | A | 12/1996 | Leonard | |
| 5,599,602 | A | 2/1997 | Leonard | |
| 5,660,922 | A | 8/1997 | Herridge | |
| 5,883,029 | A | 3/1999 | Castle | |
| 6,329,058 | B1 | 12/2001 | Arney | |
| 6,432,526 | B1 | 8/2002 | Arney | |
| 2004/0242729 | A1 | 12/2004 | Baran | |
| 2004/0242730 | A1 | 12/2004 | Baran | |
| 2007/0031686 | A1* | 2/2007 | Kendall | 428/447 |
| 2007/0196632 | A1* | 8/2007 | Meyer | B05D 5/08 428/212 |
| 2008/0152913 | A1 | 6/2008 | Shinbach | |
| 2008/0153963 | A1 | 6/2008 | Baran | |
| 2008/0286362 | A1 | 11/2008 | Baran | |
| 2011/0257055 | A1 | 10/2011 | Baran | |

FOREIGN PATENT DOCUMENTS

| | | |
|---|---|---|
| CN | 101089163 | 12/2007 |
| JP | 2005-097514 | 4/2005 |
| WO | WO 2007/031775 | 3/2007 |

* cited by examiner

*Primary Examiner* — Taiwo Oladapo
(74) *Attorney, Agent, or Firm* — Kent S. Kokko

(57) ABSTRACT

The present disclosure describes compositions and a method for forming such compositions. More specifically, inorganic microparticles and surface modified silica nanoparticles are mixed to form a composition. The surface modified silica nanoparticles are present in the composition in an amount sufficient to decrease the coefficient of friction relative to a comparable composition that is free of surface modified silica nanoparticles.

10 Claims, No Drawings

LUBRICANT COMPOSITION AND METHOD OF FORMING

CROSS REFERENCE TO RELATED APPLICATIONS

This application is a divisional application of pending prior application Ser. No. 13/141,265, filed Jun. 21, 2011 which is a national stage filing under 35 U.S.C. 371 of PCT/US2009/067607, filed Dec. 11, 2009, which claims priority to Provisional Application No. 61/141,314, filed Dec. 30, 2008, the disclosures of which are incorporated by reference in their entirety herein.

FIELD

The present disclosure relates to lubricant compositions and a method of forming lubricant compositions.

BACKGROUND

Inorganic particles having dimensions on the micrometer and/or nanometer scales have been used in many applications. Some applications having inorganic particles include, for example, use in coatings, films, abrasives, dental devices, medical appliances, and other related technology fields.

SUMMARY

The present disclosure describes lubricant compositions and a method for forming lubricant compositions. More specifically, inorganic microparticles and surface modified silica nanoparticles are mixed to form a lubricant composition. The surface modified silica nanoparticles are present in the lubricant composition in an amount sufficient to decrease the coefficient of friction relative to a comparable composition that is free of surface modified silica nanoparticles.

In one aspect, a lubricant composition is described. The lubricant composition comprises a mixture of surface modified silica nanoparticles and inorganic microparticles. The inorganic microparticles are substantially spheroidal. The concentration of the surface modified silica nanoparticles is in a range from about 0.001 weight percent to about 5 weight percent based on the total weight of the composition.

In one aspect, a method of forming a lubricant composition is described. The method includes mixing surface modified silica nanoparticles and inorganic microparticles to form the lubricant composition. The inorganic microparticles of the composition are substantially spheroidal. The concentration of the surface modified silica nanoparticles is in a range from about 0.001 weight percent to about 5 weight percent based on the total weight of the composition.

In one aspect, a method of lubricating a surface of an article is described. The method includes providing a lubricant composition comprising a mixture of surface modified silica nanoparticles and inorganic microparticles. The inorganic microparticles of the lubricant composition are substantially spheroidal. The concentration of the surface modified silica nanoparticles is in a range from about 0.001 weight percent to about 5 weight percent based on the total weight of the composition. The method included directing the lubricant composition onto the surface of the article to provide a lubricated surface.

DETAILED DESCRIPTION

Although the present disclosure is herein described in terms of specific embodiments, it will be readily apparent to those skilled in the art that various modifications, rearrangements, and substitutions can be made without departing from the spirit of the invention. The scope of the present invention is thus only limited by the claims appended herein.

The term "coefficient of friction" being either static or kinetic, generally refers to a measure of how difficult it is to slide a material of one kind over another; the coefficient of friction applies to a pair of materials and not simply to one object by itself.

The term "comparable composition" refers to a composition prepared under the same processing conditions as the lubricant composition, except for the absence of surface modified silica nanoparticles.

The term "amount sufficient" refers to a quantity of surface modified silica nanoparticles that are present in the lubricant composition to alter lubricant properties relative to a comparable composition that is free of surface modified silica nanoparticles.

The term "nanoparticle" as used herein (unless an individual context specifically implies otherwise) will generally refer to particles, groups of particles, particulate molecules (i.e., small individual groups or loosely associated groups of molecules) and groups of particulate molecules that while potentially varied in specific geometric shape have an effective, or average, diameter that can be measured on a nanoscale (i.e., less than about 100 nanometers).

The term "microparticle" as used herein (unless an individual context specifically implies otherwise) will generally refer to particles, groups of particles, particulate molecules (i.e., small individual groups or loosely associated groups of molecules) and groups of particulate molecules that while potentially varied in specific geometric shape have an effective, or average, diameter that can be measured on a microscale (i.e., greater than 0.1 micrometer to about 500 micrometers.

The terms "particle diameter" and "particle size" are defined as the maximum cross-sectional dimension of a particle. If the particle is present in the form of an aggregate, the terms, "particle diameter" and "particle size" refer to the maximum cross-sectional dimension of the aggregate.

The term "dispersion" refers to a composition that contains a mixture of surface modified silica nanoparticles and inorganic microparticles suspended or distributed in a propellant without substantial agitation or such that the mixture of particles can be dispersed again with minimal energy input. As used herein, the term "separate" or "settle" refers to forming a concentration gradient of particles within a solution due to gravitational forces.

The recitation of numerical ranges by endpoints includes all numbers subsumed within that range (e.g., 1 to 5 includes 1, 1.5, 2, 2.75, 3, 3.8, 4, and 5).

As included in this specification and the appended claims, the singular forms "a", "an", and "the" include plural referents unless the content clearly dictates otherwise. Thus, for example, reference to a composition containing "a compound" includes a mixture of two or more compounds. As used in this specification and appended claims, the term "or" is generally employed in its sense including "and/or" unless the content clearly dictates otherwise.

Unless otherwise indicated, all numbers expressing quantities or ingredients, measurement of properties and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present disclosure. At the very least, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains errors necessarily resulting from the standard deviations found in their respective testing measurements.

The present disclosure describes a lubricant composition. The lubricant composition comprises a mixture of surface modified silica nanoparticles and substantially spheroidal inorganic microparticles. Surface modified silica nanoparticles are present in the lubricant composition at a concentration in a range of about 0.001 weight percent to about 5 weight percent based on the total weight of the composition. Also, the surface modified silica nanoparticles are present in the composition in an amount sufficient to decrease the coefficient of friction relative to a composition that is free of surface modified silica nanoparticles. Surface modified silica nanoparticles are present in the composition to decrease the coefficient of friction between the inorganic microparticles thus providing lubricant properties. The substantially spheroidal geometry of the inorganic microparticles of the mixture can also provide comparable lubricant properties relative to lubricants having lamellar structures (e.g., boron nitride).

Silica nanoparticles as described herein having modified surfaces provide dispersibility and/or lubricity of the inorganic microparticles in the compositions. In general, the surface modified silica nanoparticles can reduce the amount of agglomeration and flocculation within a mixture containing inorganic microparticles. Surface modification on the silica nanoparticles can also provide dispersibility of the silica nanoparticles in propellants, solvents, and/or resins.

A method of forming a composition is described. Surface modified silica nanoparticles and inorganic microparticles are mixed to form a composition. The inorganic microparticles are substantially spheroidal. Mixing of surface modified silica nanoparticles having a concentration in a range from about 0.001 weight percent to about 5 weight percent based on the total weight of the composition with inorganic microparticles can provide compositions having lubricant properties for forming lubricant compositions. Solvent and shear mixing techniques, for example, are described for forming the lubricant composition.

Compositions are disclosed. These compositions having substantially spheroidal inorganic microparticles provide lubricant properties comparable to that of compositions containing lamellar structures described in the art. The formed compositions useful as lubricant compositions are valued in many applications for self-lubricating and dry lubricating properties at low and high temperature applications. Some examples of lubricants include graphite (hexagonal (alpha form)) and rhombohedral (beta form), boron nitride (hexagonal form), molybdenum disulfide and others. Graphite is known as a layered compound having alpha (hexagonal) and beta (rhombohedral) forms. Hexagonal boron nitride as a high temperature lubricant has the same molecular structure as graphite and is sometimes called white graphite.

Lubricant compositions can be delivered in many forms including, for example, as a powder, grease, an aerosol, or other compositions. Generally, lubricants function so as to remain in contact with moving surfaces without leaking out under gravity or centrifugal action, or to be squeezed out under pressure. Practically, lubricant compositions can retain its properties under shear at all temperatures that it is subjected to during use.

Some useful lubricant compositions include greases that are semi-fluid to solids having a fluid lubricant, a thickener and additives. The fluid lubricant can perform actual lubrication such as petroleum (mineral) oil, synthetic oil, or vegetable oil. The thickener provides grease its characteristic consistency and can be referred to as a three dimensional network to hold the oil in place. Additives enhance performance and protect the grease and lubricated surfaces.

Inorganic microparticles useful in the present disclosure typically have an average particle size as described above. Some of the inorganic microparticles can include hollow inorganic microparticles, solid inorganic microparticles or combinations thereof. Some inorganic microparticles can have a distribution of microparticle sizes, wherein a majority of the microparticles generally fall within the ranges of greater than 0.1 micrometer to about 500 micrometers. Some of the inorganic microparticles can have average particle sizes outside of the inorganic microparticle distribution.

Suitable inorganic microparticles can be further distinguished from inorganic nanoparticles useful in forming lubricant compositions by their relative size or median particle size or diameter, shape, and/or functionalization within or on the microparticle surface, wherein the inorganic microparticles are typically larger than the silica nanoparticles. Inorganic microparticles described herein are substantially spheroidal. In general, the term "spheroidal" can be used to describe geometries or shapes of microparticles. Some examples of "spheroidal" include spherical, ellipsoidal, or other known geometries. In some embodiments, inorganic microparticles have a spherical shape. In some embodiments, the inorganic microparticles are the same (e.g., in terms of size, shape, composition, microstructure, surface characteristics, etc.); while in other embodiments they are different. In some embodiments, the inorganic microparticles selected can have a modal (e.g., bi-modal or tri-modal) particle size distribution. In some embodiments, more than one type of inorganic microparticle can be useful for the formation of lubricant compositions. A combination of mixed inorganic microparticles can be used. It will be understood that inorganic microparticles can be used alone, or in combination with one or more other inorganic microparticles including mixtures and/or combinations of inorganic microparticles with silica nanoparticles for forming lubricant compositions.

Some suitable examples of silica microparticles include abrasives, metals, metal oxides and ceramic microparticles (including beads, bubbles, microspheres and aerogels). Examples of metal oxide microparticles include, for example, zirconia, titania, silica, ceria, alumina, iron oxide, vanadia, zinc oxide, antimony oxide, tin oxide, nickel oxide, calcium, and zinc phosphates, and combinations thereof. Some other suitable silica microparticles include, for example, composite structures such as those containing alumina/silica, iron oxide/titania, titania/zinc oxide, zirconia/silica, and combinations thereof. Metals such as gold, silver, or other precious metals can also be utilized as solid silica microparticles. Other examples of silica microparticles include fillers (e.g., titanium dioxide, calcium carbonate, and dicalcium phosphate, nepheline (available under the tradename designation, "MINEX" (Unimin Corporation, New Canaan, Conn.), feldspar and wollastonite), excipients, exfolients, cosmetic ingredients, silicates (e.g., talc, clay, and sericite), aluminates and combinations thereof.

Ceramic microparticles can be made using techniques known in the art and/or are commercially available. Ceramic bubbles and ceramic microspheres are described, for example, in U.S. Pat. No. 4,767,726 (Marshall), and U.S. Pat. No. 5,883,029 (Castle). Examples of commercially available glass bubbles include those marketed by 3M Company, St. Paul, Minn., under the designation "3M SCOTCHLITE GLASS BUBBLES" (e.g., grades K1, K15, S15, S22, K20, K25, S32, K37, S38, K46, S60/10000, S60HS, A16/500, A20/1000, A20/1000, A20/1000, A20/1000, H50/10000 EPX, and H50/10000 (acid washed)); glass bubbles marketed by Potter Industries, Valley Forge, Pa., under the trade designation "SPHERICEL" (e.g., grades 110P8 and 60P18), "LUXSIL", and "Q-CEL" (e.g., grades 30, 6014, 6019, 6028, 6036, 6042, 6048, 5019, 5023, and 5028); hollow glass microspheres marketed under the trade designation "DICAPERL" by Grefco Minerals, Bala Cynwyd, Pa., (e.g., grades HP-820, HP-720, HP-520, HP-220, HP-120, HP-900, HP-920, CS-10-400, CS-10-200, CS-10-125, CSM-10-300, and CSM-10-150); and hollow glass particles marketed by Silbrico Corp., Hodgkins, Ill., under the trade designation "SIL-CELL" (e.g., grades SIL 35/34, SIL-32, SIL-42, and SIL-43). Commercially available ceramic microspheres include ceramic hollow microspheres marketed by Sphere-One, Inc., Silver Plume, Colo., under the trade designation, "EXTENDOSPHERES" grades SG, CG, TG, SF-10, SF-12, SF-14, SLG, SL-90, SL-150, and XOL-200); and ceramic microspheres marketed by 3M Company under the trade designation "3M CERAMIC MICROSPHERES" (e.g., grades G-200, G-400, G-600, G-800, G-850, W-210, W-410, and W-610). In some embodiments, silica microparticles useful for forming lubricant compositions are at least one of ceramic microspheres, ceramic beads, ceramic bubbles, or silicates. In some embodiments, silica microparticles useful for forming lubricant compositions are at least one of fillers including, for example, titanium dioxide, calcium carbonate, and dicalcium phosphate.

Silica nanoparticles described in the present disclosure are surface modified silica nanoparticles. The silica nanoparticles are physically or chemically modified that is different than the composition of the bulk of the silica nanoparticles. The surface groups of the silica nanoparticle are preferably in an amount sufficient to form a monolayer, preferably a continuous monolayer, on the surface of the silica nanoparticle. The surface groups are present on the surface of the silica nanoparticles in an amount sufficient to provide silica nanoparticles that are capable of being subsequently mixed with inorganic microparticles with minimal aggregation or agglomeration.

In a method for forming a lubricant composition, surface modified silica nanoparticles are mixed with inorganic microparticles. Surface modified silica nanoparticles are present in an amount sufficient to decrease the coefficient of friction relative to a comparable composition that is free of surface modified silica nanoparticles. In some embodiments, the surface modified nanoparticles are present in the lubricant composition such that the coefficient of friction decreases by at least 5 percent as the temperature increases in a range from about 20° C. to about 200° C.

Silica nanoparticles can have geometries or shapes which include, for example, spherical, ellipsoidal, or cubic, or other known geometries. In some embodiments, it is preferred for the silica nanoparticles to be substantially spherical in shape. Generally, silica nanoparticles having aspect ratios less than or equal to 10 are considered preferred, with aspect ratios less than or equal to 3 being generally more preferred.

Suitable silica nanoparticles include, for example, metal oxide nanoparticles. In some embodiments, the silica nanoparticles may have structures including alumina/silica, zirconia/silica, and combinations thereof.

Some useful silica nanoparticles can be in the form of a colloidal dispersion. Some of these dispersions are commercially available as silica starting materials, for example, nanosized colloidal silicas available under the product designations "NALCO 1040," "NALCO 1050," "NALCO 1060," "NALCO 2326," "NALCO 2327," and "NALCO 2329" colloidal silica from Nalco Chemical Company of Naperville, Ill. Such silica nanoparticles are suitable to be surface modified and mixed with inorganic microparticles for forming lubricant compositions.

Selected silica nanoparticles of lubricant compositions will generally have an average particle size of less than 100 nanometers. In some embodiments, silica nanoparticles can be utilized having a smaller average particle size of, for example, less than or equal to 50 nanometers, less than or equal to 40 nanometers, less than or equal to 30 nanometers, less than or equal to 20 nanometers, less than or equal to 15 nanometers, less than or equal to 10 nanometers or less than or equal to 5 nanometers. In some embodiments, the average particle size of the silica nanoparticles can be in a range from about 2 nanometers to about 20 nanometers, in a range of about 3 nanometers to about 15 nanometers, or in a range of about 4 nanometers to about 10 nanometers.

Surfaces of the selected silica nanoparticles can be chemically or physically modified, for example, by covalent chemical bonding, by hydrogen bonding, by electrostatic attraction, by London forces and by hydrophilic or hydrophobic interactions so long as the interaction is maintained at least during the time period required for the silica nanoparticles to achieve their intended utility. The surface of the silica nanoparticle can be modified with one or more surface modifying groups. The surface modifying groups can be derived from a myriad of surface modifying agents or compounds. Schematically, surface modifying agents may be represented by the following general formula (I):

$$A\text{-}B \qquad (I)$$

The A group of Formula I is a group or moiety that is capable of attaching to the surface of the silica nanoparticle. In those situations where the silica nanoparticle is processed in solvent, the B group is a compatibilizing group with whatever solvent is used to process the silica nanoparticles. In those situations where the silica nanoparticles are not processed in solvent, the B group is a group or moiety that is capable of preventing irreversible agglomeration of the silica nanoparticles. It is possible for the A and B components to be the same, where the attaching group may also be capable of providing the desired surface compatibility. The compatibilizing group may be reactive, but is generally non-reactive, with the inorganic microparticles. It is understood that the attaching composition may be comprised of more than one component or created in more than one step, e.g., the A composition may be comprised of an A' moiety which is reacted with the surface of an silica nanoparticle, followed by an A" moiety which can then be reacted with B. The sequence of addition is not important, i.e., the A'A"B component reactions can be wholly or partly performed prior to attachment to the silica nanoparticle.

In some embodiments, surface-modifying agents include silanes. Examples of silanes include organosilanes such as alkylchlorosilanes; alkoxysilanes (e.g., methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, butyltrimethoxysilane, butyltriethoxysilane, hexyltrimethoxysilane, octyltrimethoxysilane, 3-mercaptopropyltrimethoxysilane, n-octyltriethoxysilane, isooctyltrimethoxysilane, phenyltriethoxysilane, polytriethoxysilane, vinyltrimethoxysilane, vinyldimethylethoxysilane, vinylmethyldiacetoxysilane, vinylmethyldiethoxysilane, vinyltriacetoxysilane, vinyltriethoxysilane, vinyltriisopropoxysilane, vinyltrimethoxysilane, vinyltriphenoxysilane, vinyltri(t-butoxy)silane, vinyltris(isobutoxy)silane, vinyltris(isopropenoxy)silane, and vinyltris(2-methoxyethoxy)silane; trialkoxyarylsilanes; isooctyltrimethoxy-silane; N-(3-triethoxysilylpropyl)methoxyethoxyethoxy ethyl carbamate; N-(3-triethoxysilylpropyl) methoxyethoxyethoxyethyl carbamate; silane functional (meth)acrylates (e.g., 3-(methacryloyloxy)propyltrimethoxysilane, 3-acryloyloxypropyltrimethoxysilane, 3-(methacryloyloxy)propyltriethoxysilane, 3-(methacryloyloxy)propylmethyldimethoxysilane, 3-(acryloyloxypropyl)methyldimethoxysilane, 3-(methacryloyloxy)propyldimethylethoxysilane, 3-(methacryloyloxy)methyltriethoxysilane, 3-(methacryloyloxy) methyltrimethoxysilane, 3-(methacryloyloxy) propyldimethylethoxysilane, 3-(methacryloyloxy) propenyltrimethoxysilane, and 3-(methacryloyloxy) propyltrimethoxysilane)); polydialkylsiloxanes (e.g., polydimethylsiloxane); arylsilanes (e.g., substituted and unsubstituted arylsilanes); alkylsilanes (e.g., substituted and unsubstituted alkyl silanes (e.g., methoxy and hydroxy substituted alkyl silanes)), and combinations thereof. In some embodiments, the surface modifying agent for the silica nanoparticles can be an unsubstituted alkylsilane. In some embodiments, the surface modifying agent for the silica nanoparticles can be isooctyltrimethoxysilane, where the silica nanoparticles are isooctyl functionalized silica nanoparticles after chemical modification.

In some embodiments, surface-modified silica nanoparticles can include silica nanoparticles surface modified with silane surface modifying agents (e.g., acryloyloxypropyl trimethoxysilane, 3-methacryloyloxypropyltrimethoxysilane, 3-mercaptopropyltrimethoxysilane, n-octyltrimethoxysilane, isooctyltrimethoxysilane, and combinations thereof). Silica nanoparticles can be treated with a number of surface modifying agents (e.g., alcohol, organosilane (e.g., alkyltrichlorosilanes, trialkoxyarylsilanes, trialkoxy(alkyl)silanes, and combinations thereof), and organotitanates and mixtures thereof).

In some embodiments, silica nanoparticle surfaces can also be modified with organic acid surface-modifying agents which include oxyacids of carbon (e.g., carboxylic acid), sulfur and phosphorus, acid derivatized poly(ethylene) glycols (PEGs) and combinations of any of these. Suitable phosphorus containing acids include phosphonic acids (e.g., octylphosphonic acid, laurylphosphonic acid, decylphosphonic acid, dodecylphosphonic acid, and octadecylphosphonic acid), monopolyethylene glycol phosphonate and phosphates (e.g., lauryl or stearyl phosphate). Suitable sulfur containing acids include sulfates and sulfonic acids including dodecyl sulfate and lauryl sulfonate. Any such acids may be used in either acid or salt forms.

In some embodiments, non-silane surface modifying agents for silica nanoparticles include, for example, acrylic acid, methacrylic acid, beta-carboxyethyl acrylate, mono-2-(methacryloyloxyethyl) succinate, mono(methacryloyloxypolyethyleneglycol) succinate and combinations of one or more of such agents. In another embodiment, surface modifying agents incorporate a carboxylic acid functionality such as $CH_3O(CH_2CH_2O)_2CH_2COOH$, 2-(2-methoxyethoxy) acetic acid having the chemical structure $CH_3OCH_2CH_2OCH_2COOH$, mono(polyethylene glycol) succinate in either acid or salt form, octanoic acid, dodecanoic acid, stearic acid, acrylic and oleic acid or their acidic derivatives.

In some embodiments, organic base surface modifying agents for silica nanoparticles can include alkylamines (e.g., octylamine, decylamine, dodecylamine, octadecylamine, and monopolyethylene glycol amines).

In some embodiments, surface-modifying alcohols and thiols can also be employed including aliphatic alcohols (e.g., octadecyl, dodecyl, lauryl and furfuryl alcohol), alicyclic alcohols (e.g., cyclohexanol), and aromatic alcohols (e.g., phenol and benzyl alcohol), and combinations thereof.

In some embodiments, surface-modified silica nanoparticles are generally selected in such a way that lubricant compositions formed with them are free from a degree of particle agglomeration or aggregation that would interfere with its lubricant properties. The surface-modified silica nanoparticles are generally selected to be either hydrophobic or hydrophilic such that, depending on the character of the silica microparticles for mixing, the resulting lubricant composition exhibits substantially free flowing (i.e., the ability of a material to maintain a stable, steady and uniform/consistently flow, as individual particles) properties.

In some embodiments, a variety of methods are available for modifying the surfaces of silica nanoparticles. A surface modifying agent can, for example, be added to silica nanoparticles (e.g., in the form of a powder or a colloidal dispersion) and the surface modifying agent can be allowed to react with the silica nanoparticles. Multiple synthetic sequences to bring the silica nanoparticle together with the surface modifying group are possible.

In some embodiments, suitable surface modification of the silica nanoparticles can be selected based upon the nature of the silica nanoparticles used as well as the desired properties of the surface modified silica nanoparticles in the resulting lubricant composition. When using a solvent during formation of the surface modified silica nanoparticles which is hydrophobic, for example, one skilled in the art can select from among various hydrophobic surface groups to achieve surface modified silica nanoparticles that are compatible with the hydrophobic solvent; when the processing solvent is hydrophilic, one skilled in the art can select from various hydrophilic surface groups; and, when the solvent is a hydrofluorocarbon or fluorocarbon, one skilled in the art can select from among various compatible surface groups; and so forth. The nature of the silica nanoparticles and the solvent in addition to the desired final properties can also affect the selection of the surface modifying agents.

In some embodiments, surface modified silica nanoparticles as described herein are mixed with inorganic microparticles such that the lubricant compositions are substantially free from particle association, agglomeration, or aggregation. As used herein, particle "association" is defined as a reversible chemical combination due to any of the weaker classes of chemical bonding forces. Examples of particle association include hydrogen bonding, electrostatic attraction, London forces, van der Waals forces, and hydrophobic interactions. As used herein, the term "agglomeration" is defined as a combination of molecules or colloidal particles into clusters. Agglomeration may occur due to the neutralization of the electric charges, and is typically reversible. As used herein, the term "aggregation" is defined as the tendency of large molecules or colloidal particles to combine in clusters or clumps and precipitate or separate from the dissolved state. Aggregated particles of the lubricant compositions are firmly associated with one another, and require high shear to be broken. Agglomerated and associated particles of the lubricant compositions can generally be easily separated.

In some embodiments, surface modified silica nanoparticles are selected such that, as described in more detail herein, it is compatible with the inorganic microparticles with which it is mixed and is suitable for the lubricant applications for which it is intended. Generally, the selection of the silica nanoparticles will be governed at least in part by the specific performance requirements for the lubricant composition and any more general requirements for the intended application. For example, the performance requirements for solid or liquid lubricant compositions might require that the silica nanoparticles have certain dimensional characteristics (size and shape), compatibility with the surface modifying materials along with certain stability requirements (insolubility in a processing or mixing solvent). Further requirements might be prescribed by the intended use or application of the lubricant composition. Such requirements might include, for example, stability under more extreme environments, such as high temperatures. Silica particle emulsions and dispersions containing nanoparticles have been described in U.S. Patent Application Publications 2004/0242729 and 2004/0242730 (Baran Jr., et al.), herein incorporated by reference.

In some embodiments, the weight ratio of surface modified silica nanoparticles to inorganic microparticles of the lubricant composition described herein is at least 1:100,000. In some embodiments, the weight ratio of surface modified silica nanoparticles to inorganic microparticles is in a range from about 1:100,000 to about 1:20, in a range from about 1:10,000 to about 1:500, in a range from about 1:5,000 to about 1:1,000.

In some embodiments, lubricant compositions of the present disclosure are formed by mixing surface modified silica nanoparticles and inorganic microparticles. Mixing of particles can be accomplished by high shear mixing, low shear mixing, solvent blending, and other known mixing techniques. The formed lubricant composition comprises surface modified silica nanoparticles in an effective amount sufficient to decrease the coefficient of friction relative to a comparable composition free of surface modified silica nanoparticles.

A variety of equipment and techniques are known in the art for mixing particles in compositions. Examples of such equipment and techniques are disclosed, for example, in U.S. Pat. No. 3,565,985 (Schrenk et al.), U.S. Pat. No. 5,427,847 (Bland et al.), U.S. Pat. No. 5,589,122 and U.S. Pat. No. 5,599,602 (Leonard et al.), and U.S. Pat. No. 5,660,922 (Henidge et al.). Some examples of high shear and low shear processing equipment include, but are not limited to, high speed mixers, extruders (single and twin screw), batch off extruders, Banbury mixers, and Brabender extruders. In some embodiments, a lubricant composition is mixed in a high speed mixer. The composition can be mixed at high speeds in the range of about 500 to about 2,000 rpm.

In some embodiments, the coefficient of friction of the lubricant composition relative to a comparable composition that is free of surface modified silica nanoparticles is decreased by at least 5 percent. In some embodiments, the coefficient of friction of the lubricant composition is decreased by 7 percent, by 15 percent, or by at least 20 percent relative to a comparable composition.

Lubricant compositions of the present disclosure comprise a mixture of surface modified silica nanoparticles mixed with substantially spheroidal inorganic microparticles. Not to be bound by theory, the spheroidal geometry (e.g., shape) of the inorganic microparticles when mixed with surface modified silica nanoparticles can also contribute to lubricant properties including those compositions having lower coefficient of friction results than comparable compositions free of surface modified silica nanoparticles. In some embodiments, the lubricant composition is a powder. In some embodiments, the lubricant composition is grease. In some embodiments, the lubricant composition further comprises a film forming material (e.g., resin).

In some embodiments, a mixture of surface modified silica nanoparticles and inorganic microparticles can provide lubricants in the form of sprayable dispersion compositions. The mixture of surface modified silica nanoparticles and inorganic microparticles can be dispersed in a propellant or a solvent and remain stable over a useful time period without substantial agitation or which are easily redispersed with minimal energy input. The sprayable dispersion compositions described herein comprises the mixture of particles and a propellant or solvent as a continuous phase which are rendered stable by incorporation of an effective amount of particles into the continuous phase. An effective amount of particles is an amount that has minimized the aggregation of the dispersed inorganic microparticles and forms stable dispersions that remain dispersed over a useful time period without substantial agitation of the dispersion or which are easily redispersed with minimal energy input. Without wishing to be bound by theory, composite particles are believed to sterically inhibit aggregation of themselves and not through particle charge.

Suitable propellants include, for example, a chlorofluorocarbon (CFC), such as trichlorofluoromethane, dichlorodifluoromethane, and 1,2-dichlorodifluoromethane, and 1,2-dichloro-1,1,2,2,-tetrafluoroethane, a hydrochlorofluorocarbon, such as 1,1,1,2-tetrafluoroethane and 1,1,1,2,3,3,3-heptafluoropropane, carbon dioxide, dimethyl ether, isobutane, butane, propane, or mixtures thereof. In other embodiments, the propellant includes a chlorofluorocarbon, a hydrochlorofluorocarbon, a hydrofluorocarbon, or mixtures thereof. In some embodiments, a mixture of propellants for dispersing composite particles comprises isobutane and dimethyl ether. The propellant(s) for the sprayable dispersions is equal to or greater than 70 weight percent of the total weight of the dispersion. In some embodiments, the propellant has a concentration in a range from about 70 percent to about 99.9 weight percent, in a range from about 75 weight percent to about 95 weight percent, in a range from about 80 weight percent to about 95 weight percent, or in a range from about 85 to about 95 weight percent based on the total weight of the mixture and the propellant of the dispersion.

In some embodiments, the sprayable dispersion compositions can comprise other compounds or materials. Some of these compounds can include, for example, surfactants, stabilizers, additives and other known materials.

In one aspect, a method of lubricating a surface of an article is described. The lubricant composition as described herein can be directed onto the surface on the article to provide a lubricated surface. In come embodiments, the lubricant composition can be directed (e.g., applied) by spraying, dusting, spreading, and combinations thereof. Spraying of lubricant compositions can aerosolized compositions and pressurized compositions for delivery to surfaces. Dusting of lubricant compositions can include, for example, sprinkling of dry lubricant compositions onto surfaces to provide lubricated surfaces (e.g., mold release materials or agents). Spreading of lubricant compositions to provide lubricated surfaces can include applications including wovens, nonwovens, and the like.

The disclosure will be further clarified by the following examples which are exemplary and not intended to limit the scope of the disclosure.

EXAMPLES

Unless otherwise noted, all parts, percentages, and ratios reported in the following examples are on a weight basis, and all reagents used in the examples were obtained, or are available, from the chemical suppliers described below, or can be synthesized by conventional techniques.

Coefficient of Friction

Coefficient of Friction Powder Test measurements (CFPT) were recorded on a Falex Multi-Specimen Test Machine, Computer Controlled Version (Serial No. 900631001816R; Falex Corporation, Sugar Grove, Ill.). The dry sample was placed in a specimen trough followed by assembly of the test machine adapter for testing. Testing of the dry sample in the adapter was conducted at a speed of 30 rpm at loads of 11 kg, 22 kg, 44 kg, and 66 kg. The dry sample testing was conducted at ambient conditions (20° C.) for 10 minutes or until friction measurement stabilized in the test equipment. Testing at 200° C. for the samples was conducted for 10 minutes at a load of 66 kg. The mean test radius was 1.26 cm.

Wall Friction Testing (Rheometer)

Wall Friction Test measurements were recorded on a Freeman FT4 Rheometer (Freeman, Worcestershire, England) using a wall friction module (pre-installed software) from the manufacturer. A 50 ml dry sample was placed in the sample holder and the samples were tested using a mirror plate having a compression force in a range from 3 kPa to 9 KPa at a temperature of 20° C. Shear stress (kPa) results were recorded under a normal stress (kPa) in a range from 3 kPa and 9 kPa. Shear stress test results are listed in Table 2 at 3 kPa and 9 kPa.

Preparatory Example 1 (PE 1)

Surface Modified Silica Nanoparticles

A mixture of Nalco 2326 colloidal silica (16.06 wt. % solids in water; 5 nm; Nalco, Bedford Park, Ill.) (100 grams), 7.54 grams of isooctyltrimethoxy silane (Gelest, Morrisville, Pa.), 0.81 grams of methyltrimethoxysilane (Gelest, Morrisville, Pa.), and 112.5 grams of an 80:20 (weight) wt./wt. % solvent blend of ethanol (EMD, Gibbstown, N.J.): methanol (VWR, West Chester, Pa.) were added to a 500 ml 3-neck round bottom flask (Ace Glass, Vineland, N.J.) equipped with a stirring rod/paddle assembly and a condenser (Ace Glass, Vineland, N.J.). The flask containing the mixture was placed in an oil bath set at 80° C. and stirred for 4 hours to provide surface modified nanoparticles. The surface modified nanoparticles were transferred to a crystallizing dish and dried in a convention oven at 150° C. for 2 hours. The dried surface modified nanoparticles were ground with a mortar and pestle and stored in a glass container.

Example 1

A mixture of CM 111 ceramic microspheres (60 grams) and surface modified nanoparticles of Preparatory Example 1 (0.30 grams) was mixed in a FlackTek DAC 150 FVZ speed-mixer (Landrum, S.C.) for 1.5 minutes at 2000 rpm, and then mixed again for 1 minute at 1500 rpm at 20° C. to form a lubricant composition. Coefficient of friction testing results for Example 1 conducted at 20° C. and 200° C. are listed in Table 1.

Example 2

A mixture of W610 ceramic microspheres (200 grams) and surface modified nanoparticles of Preparatory Example 1 (2.0 grams) was mixed in a FlackTek DAC 150 FVZ speed-mixer (Landrum, S.C.) for 1.5 minutes at 2000 rpm, and then mixed again for 1 minute at 1500 rpm at ambient conditions to form a lubricant composition. Coefficient of friction testing results for Example 2 conducted at 20° C. and 200° C. are listed in Table 1.

Comparative Example 1 (CE1)

CM111 ceramic microspheres (3M Company, Saint Paul, Minn.) were mixed as described in Example 1, except without the surface modified silica nanoparticles of Preparatory Example 1. CM111 ceramic microspheres were investigated for coefficient of friction measurements. Coefficient of friction results for CE1 conducted at 20° C. and 200° C. are listed in Table 1.

Comparative Example 2 (CE2)

W610 ceramic microspheres (3M Company, St. Paul, Minn.) were mixed as described in Example 2, except without the surface modified nanoparticles of Preparatory Example 1. W610 ceramic microspheres were investigated for coefficient of friction measurements. Coefficient of friction testing results for CE2 conducted at 20° C. and 200° C. are listed in Table 1.

Comparative Examples 3-4 (CE3-CE4)

Boron Nitride CC6097 particles (Momentive Performance Materials Quartz Inc., Strongsville, Ohio) as CE3, and Boron Nitride PTX25 particles (Momentive Performance Materials Quartz Inc, Strongsville, Ohio) as CE4 were investigated for coefficient of friction measurements. Coefficient of friction testing results for CE3 and CE4 conducted at 20° C. and 200° C. are listed in Table 1.

TABLE 1

| Example | Materials | Surface Modified Silica Nanoparticle Content (%) | Coefficient of Friction (20° C.) | Coefficient of Friction (200° C.) |
|---|---|---|---|---|
| 1 | * Mixture | 1.0 | 0.375 | 0.441 |
| CE1 | Micro-particles | N/A | 0.417 | 0.499 |
| 2 | * Mixture | 1.0 | 0.237 | 0.164 |
| CE2 | Micro-particles | N/A | 0.437 | 0.391 |
| CE3 | Particles | N/A | 0.330 | 0.417 |
| CE4 | Particles | N/A | 0.300 | 0.345 |

* Surface modified silica nanoparticles and inorganic microparticles

In Table 1, Example 1 has lower coefficient of friction test results than CE1 at the temperatures indicated. Example 2 shows a decrease in the coefficient of friction as the temperature increases from 20° C. to a temperature of 200° C. CE5 and CE6 show an increase in the coefficient of friction at 200° C.

Comparative Example 5 (CE5)

A mixture of calcium carbonate (($CaCO_3$); average particle size: 10 micrometers; Sigma-Aldrich, Milwaukee, Wis.) (99 grams) and surface modified nanoparticles of Preparatory Example 1 (1 gram) was mixed in a FlackTek DAC 150 FVZ speed-mixer (Landrum, S.C.) for 1.5 minutes at 2000 rpm, and then mixed again for 1 minute at 1500 rpm at 20° C. to form a composition. Wall Friction test results (shear stress) for CE5 conducted at 20° C. are listed in Table 2.

Comparative Example 6 (CE6)

Composite Particle

A mixture of Nalco 2326 colloidal silica (16.14 wt. % solids in water; 5 nm; Nalco, Bedford Park, Ill.) (12.5 grams), and an 80:20 (weight) wt./wt. % solvent blend of ethanol (EMD, Gibbstown, N.J.): methanol (VWR, West Chester, Pa.) (100 grams) was added to a 2 liter three-neck round bottom flask (Ace Glass, Vineland, N.J.) equipped with a mechanical stirrer (Sigma-Aldrich, St. Louis, Mo.) and mixed for 5 minutes at room temperature. Isooctyltrimethoxysilane (Gelest, Morrisville, Pa.) (0.94 grams), methyltrimethoxysilane (0.10 grams), and an additional 400 grams of the ethanol: methanol solvent blend were added to the 2 liter round bottom flask and stirred for an additional 5 minutes at room temperature. The contents within the flask were heated in an oil bath set at 80° C. and stirred for 3 hours. Next, 200 grams of calcium carbonate (($CaCO_3$); average particle size: 10 micrometers; Sigma-Aldrich, Milwaukee, Wis.) were added to the mixture and stirred at 80° C. for an additional 16 hours to composite particles (nanoparticle covalently bonded to microparticles). The mixture was transferred to crystallizing dishes (Sigma-Aldrich, St. Louis, Mo.) and dried in a convection oven at 130° C. for 2 hours. The dried mixture (10 grams) was added to a 250 ml Erlenmayer flask and stirred with an excess of toluene (EMD, Gibbstown, N.J.) (40 grams) for 5 hours at 20° C. and filtered. The filtrate (toluene) was transferred to a 500 ml round bottom flask, and concentrated with a rotary evaporator R-210 (Buchi Labortechnik AG; Switzerland) to recover unreacted 5 nm silica nanoparticles. Wall friction test results (shear stress) for CE6 (composite particle) were conducted at 20° C. as listed in Table 2.

Comparative Example 7 (CE7)

Calcium carbonate was mixed as described in CE7, except without the surface modified nanoparticles of Preparatory Example 1. $CaCO_3$ was investigated for wall friction test measurements. Wall friction test results for CE7 conducted at 20° C. are listed in Table 2.

TABLE 2

Wall Friction Test Results

| Example | Materials | Surface Modified Silica Nanoparticle Content (%) | Shear Stress (kPa) @ Normal Stress (3 kPa) | Shear Stress (kPa) @ Normal Stress (9 kPa) |
|---|---|---|---|---|
| CE5 | * Mixture | 1.0 | 1.6 | 3.2 |
| CE6 | Composite | 1.0 | 1.05 | 2.6 |
| CE7 | Micro-particles | N/A | 0.7 | 1.6 |
| CE3 | Particles | N/A | 0.7 | 1.7 |
| CE4 | Particles | N/A | 1.0 | 3.2 |

* Surface modified silica nanoparticles and inorganic microparticles

In Table 2, CE3 had higher shear stress values than CE5 and CE6. CE6 had similar shear stress test results to CE3 at a normal stress range from 3 kPa to 9 kPa.

What is claimed is:

1. A method of forming a lubricant composition comprising:

mixing a propellant, surface modified silica nanoparticles and inorganic microparticles to form a sprayable dispersion lubricant composition, the inorganic microparticles being substantially spheroidal, wherein the concentration of the surface modified silica nanoparticles is in a range from about 0.001 weight percent to about 5 weight percent based on the total weight of the microparticles and nanoparticles, and wherein the amount of propellant(s) is equal to or greater than 70 weight percent of the total weight of the dispersion.

2. The method of claim 1, wherein the step of mixing is selected from the group consisting of high shear mixing, low shear mixing, solvent blending, and combinations thereof.

3. The method of claim 1, wherein the lubricant composition has a coefficient of friction which decreases by at least 5 percent as the temperature of the lubricant composition increases from 20° C. to 200° C.

4. The method of claim 1, wherein the inorganic microparticles have an average particle size in a range of greater than 0.1 micrometer to about 500 micrometers.

5. The method of claim 1, wherein the inorganic microparticles are selected from the group consisting of zirconia, titania, silica, ceria, alumina, iron oxide, vanadia, zinc oxide, antimony oxide, tin oxide, nickel oxide, and combinations thereof.

6. A method of lubricating a surface of an article comprising:

providing a sprayable dispersion lubricant composition comprising a mixture of propellant, surface modified silica nanoparticles and inorganic microparticles, the inorganic microparticles being substantially spheroidal, wherein the concentration of the surface modified silica nanoparticles is in a range from about 0.001 weight percent to about 5 weight percent based on the total weight of the microparticles and nanoparticles, and wherein the amount of propellant(s) is equal to or greater than 70 weight percent of the total weight of the dispersion, and directing the composition onto the surface of the article to provide a lubricated surface.

7. The method of claim 6, wherein the lubricant composition has a coefficient of friction which decreases by at least 5 percent as the temperature of the lubricant composition increases from 20° C. to 200° C.

8. The method of claim 6, wherein the inorganic microparticles have an average particle size in a range of greater than 0.1 micrometer to about 500 micrometers.

9. The method of claim 6, wherein the inorganic microparticles are selected from the group consisting of zirconia, titania, silica, ceria, alumina, iron oxide, vanadia, zinc oxide, antimony oxide, tin oxide, nickel oxide, and combinations thereof.

10. A method of forming a lubricant composition comprising:

mixing a propellant, surface modified silica nanoparticles and inorganic microparticles to form a sprayable dispersion lubricant composition, the inorganic microparticles being substantially spheroidal, wherein the concentration of the surface modified silica nanoparticles, absent the propellant(s), is in a range from about 0.001 weight percent to about 5 weight percent based on the total weight of the lubricant composition, and wherein the amount of propellant(s) is equal to or greater than 70 weight percent of the total weight of the dispersion.

* * * * *